United States Patent [19]

Mosehauer et al.

[11] Patent Number: 4,791,450

[45] Date of Patent: Dec. 13, 1988

[54] MULTICOLOR ELECTROPHOTOGRAPHIC REPRODUCTION APPARATUS AND METHOD FOR PRODUCING COLOR ACCENTED COPIES

[75] Inventors: Michael Mosehauer, Rochester; Jerome G. Spitzner, deceased, late of Byron, by Nona V. Spitzner, administratrix; Michael D. Stoudt, Webster; Eric K. Zeise, Pittsford, all of N.Y.

[73] Assignee: Eastman Kodak Company, Rochester, N.Y.

[21] Appl. No.: 28,804

[22] Filed: Mar. 20, 1987

Related U.S. Application Data

[63] Continuation of Ser. No. 809,546, Dec. 16, 1985, abandoned.

[51] Int. Cl.[4] ..... G03G 15/01

[52] U.S. Cl. ..... 355/4; 355/77; 355/7; 430/42; 358/283

[58] Field of Search ..... 355/4, 14 D, 77, 3 CH, 355/14 CH, 32, 14 R, 7; 430/42, 43; 358/80, 283; 346/157

[56] References Cited

U.S. PATENT DOCUMENTS

| | | | |
|---|---|---|---|
| 3,930,724 | 1/1976 | McVeigh | 355/7 |
| 3,936,173 | 8/1976 | Kidd et al. | 355/3 R |
| 3,947,114 | 3/1976 | Washio et al. | 355/4 |
| 4,008,962 | 5/1977 | Nepper | 355/77 |
| 4,012,122 | 3/1977 | McVeigh | 355/40 X |
| 4,045,218 | 8/1977 | McVeigh | 355/4 X |
| 4,068,940 | 3/1978 | Bobbe | 355/4 |
| 4,106,870 | 8/1978 | Kondo et al. | 355/4 |
| 4,204,728 | 5/1980 | Goshima et al. | 355/4 |
| 4,275,958 | 6/1981 | Tachika et al. | 355/4 X |
| 4,472,047 | 9/1984 | Stoudt | 355/4 |
| 4,537,490 | 8/1985 | Stoudt | 355/4 X |
| 4,668,978 | 5/1987 | Gokita | 355/4 X |
| 4,707,713 | 11/1987 | Ayata et al. | 355/7 X |

FOREIGN PATENT DOCUMENTS

| | | |
|---|---|---|
| 103843 | 9/1983 | European Pat. Off. . |
| 60/166970 | 8/1985 | Japan . |
| 60/166969 | 8/1985 | Japan . |
| 2163923 | 8/1985 | United Kingdom . |
| 2163924 | 8/1985 | United Kingdom . |

*Primary Examiner*—R. L. Moses

*Attorney, Agent, or Firm*—Norman Rushefsky

[57] ABSTRACT

A multicolor electrophotographic reproduction apparatus and method are provided for reproducing a copy in a selected colors. The apparatus includes a digitizer for inputting information denoting the location(s) of the pictorial information and the location(s) for which selected coloration is desired. The respective colors desired for reproduction of the information may be chosen from a menu of twenty-five or more colors stored in memory. In addition to an exposure source for reproducing an image of the original upon a photoconductor the apparatus also includes an illumination source for selective erase and a second illumination source which illuminates the photoconductor through a halftone screen to control the charge level on areas of a color separation image frame in accordance with the color selected to thereby effect the color which a reproduction will have.

19 Claims, 5 Drawing Sheets

TO 44
61
59
58
57
ACCENT INPUT
FORMAT INPUT
CP
TO 44
51
52
53
54
DIGITIZER
FROM COPIER & FEEDER FIG. 2
50
INPUT SIGNAL BUFFERS
41
INPUT DATA PROCESSOR
45
INTERRUPT SIGNAL PROCESSOR
FROM CP
31
46
STORED PROGRAM CONTROL
43
CENTRAL PROCESSING UNIT
42
TEMPORARY MEMORY
44
TIMING AND CYCLE CONTROL
47
OUTPUT DATA STORAGE LATCHES
48
OUTPUT DRIVERS
80
82
81
FROM 48
12
85
86
82
FROM 48
X
Y
X'
Y'
X''
Y''
e
D
g
f

MULTICOLOR ELECTROPHOTOGRAPHIC REPRODUCTION APPARATUS AND METHOD FOR PRODUCING COLOR ACCENTED COPIES

This is a continuation of application Ser. No. 809,546, filed Dec. 16, 1985, now abandoned.

CROSS REFERENCE TO RELATED APPLICATION

This application is related to commonly assigned U.S. patent application Ser. No. 809,549, filed on Dec. 16, 1985 in the names of Pierce B. Day and George N. Tsilibes and entitled, "Electrophotographic Reproduction Apparatus and Method with Selective Screening"; to U.S. patent application Ser. No. 809,548, filed on Dec. 16, 1985 in the name of George N. Tsilibes and entitled, "Electrophotographic Apparatus and Method With Automatic Selective Screening;" both now abandoned in favor of continuation-in-part U.S. application Ser. No. 940,694, filed Dec. 11, 1986; and to U.S. patent application Ser. No. 809,550, filed on even date herewith in the names of Michael D. Stoudt et al and entitled, "Apparatus and Method for Electrophotographically Producing Copies from Originals Having Continuous-Tone and other Content."

BACKGROUND OF THE INVENTION

1. Field of the Invention

The present invention relates to multicolor electrophotographic reproduction apparatus and methods and, more specifically, to the improved production of copy in selected colors.

2. Brief Description of the Prior Art

In U.S. Patent 4,045,218 an apparatus is described for producing color accented reproductions from originals of a single color. In this method, an original such as a letter is placed at a copier's exposure station and an indicator member adjusted to identify which lines are to be reproduced in which colors. For example, the first ten lines of an original black-on-white letter may be desired to be reproduced in say red and the remainder of the letter to be reproduced in its original color black. In this example the patent discloses that the entire original may be exposed onto a primary charged photoconductor to produce a latent electrostatic image thereof and the portion to be reproduced in black is erased by an electroluminescent panel. The remaining image is then developed with red toner. The original is then again exposed onto the photoconductor but this time the information to be reproduced in red is erased and the electrostatic latent image developed with black toner. The two toner images are then transferred to a copy sheet in registration with one another to provide the multicolored reproduction. The patent discloses that three colors may be provided in the reproductions where three developer stations are used.

A problem with the apparatus described in this patent is in the reproduction of originals with composite information. For example, it is often desirable to reproduce with its original coloration a multicolored pictorial while providing color accenting to line-type material such as alphanumerics and logos, etc. It would also be desirable to provide color accenting in many colors, for example 25, without providing significantly more color development units.

SUMMARY OF THE INVENTION

The invention is directed to an electrophotographic reproduction method and apparatus for producing copies with color accenting, i.e., in colors different from that of an original.

In a preferred embodiment of the invention signals are provided related to the desired color and position of an image are to be color accented. A plurality of image frames are used to reproduce the original. However, the charge level on one of these image frame(s) is reduced from its primary voltage to an intermediate level needed for the color accenting. Information not to be reproduced by color accenting is selectively erased entirely from this image frame. In a three color copier using subtractive colored toners of cyan, magenta and yellow, more than three image frames may be used to produce copy. The additional frames being used to provide intermediate charge levels needed for color accenting. For example, where up to six image frames are used to produce copy, three of the frames may be devoted to reproducing information near the primary charge level of $V_o$ with selected areas erasable to a level below which will permit development. In a system constrained to use only these three frames with three colors, $2^3$, or 8 color combinations are possible. In the apparatus and method of the invention the use of an extra three frames available for charge levels at say one-half $V_o$ allows for $3^3$, or 27 colors, i.e., 25 colors plus black and white.

In the preferred embodiment the charge level is reduced to one-half $V_o$ on the selected image frame by exposure of a non-image information bearing light source through a half-tone screen.

BRIEF DESCRIPTION OF THE DRAWINGS

The subsequent description of the preferred embodiments of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
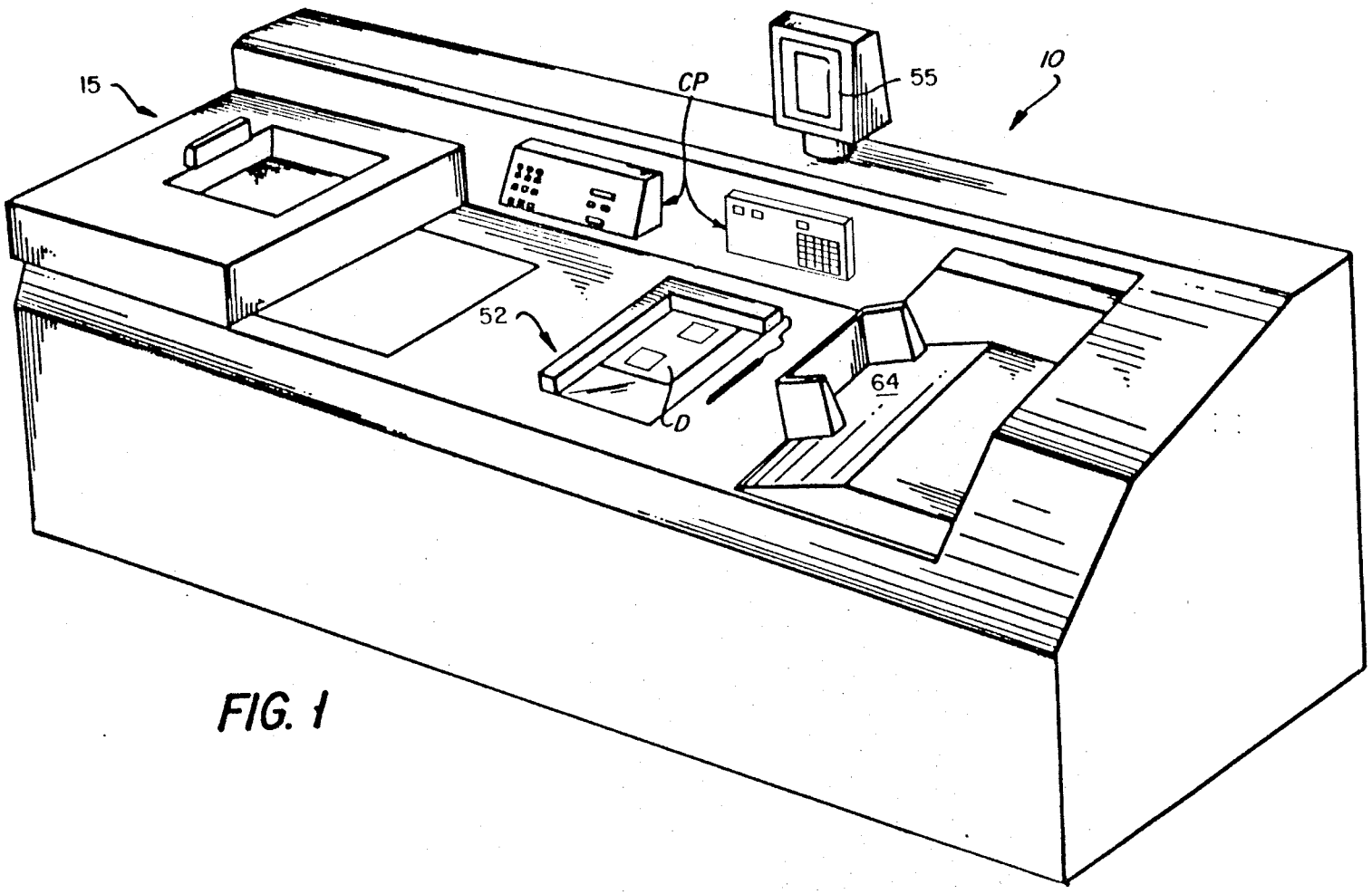
FIG. 1 is a perspective view of a multicolor electrophotographic reproduction apparatus for practice of the present invention.
Figure 2:
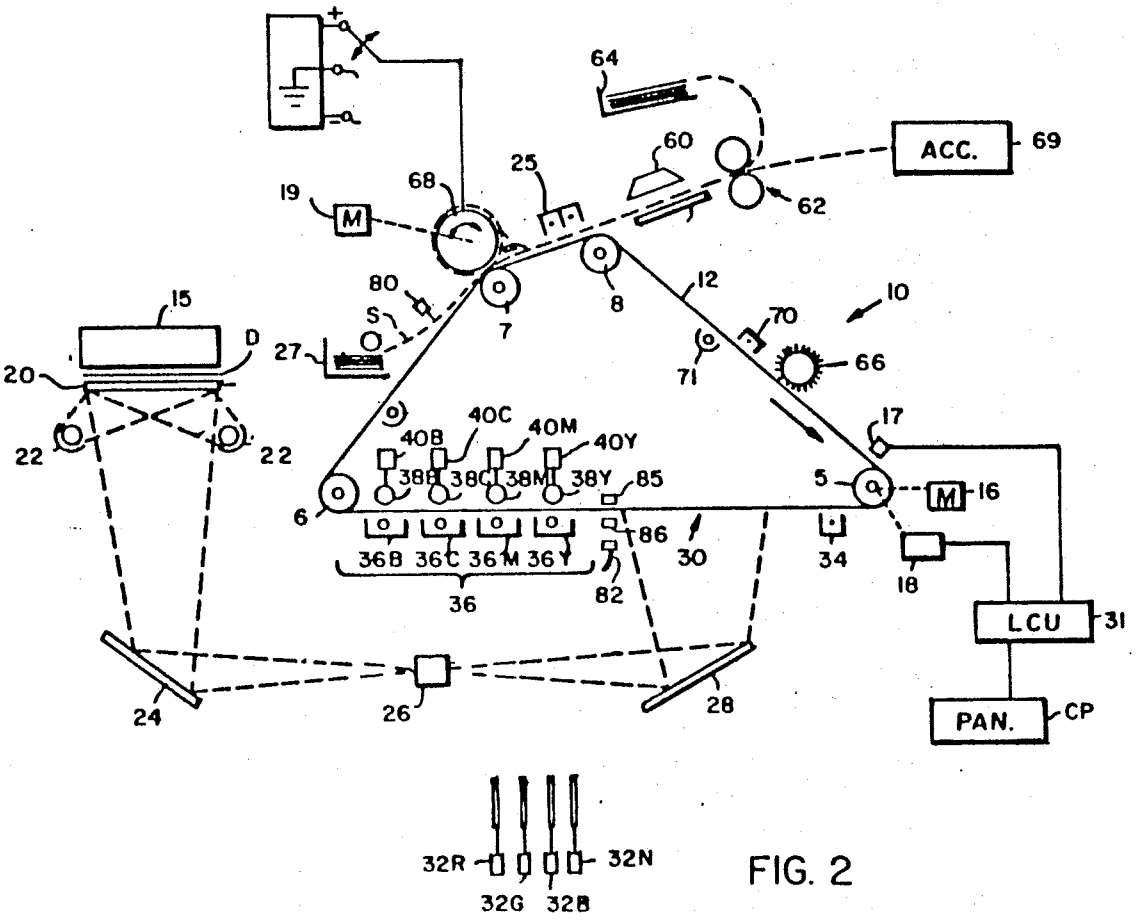
FIG. 2 is a schematic side view of the operating elements of the multicolor electrophotographic reproduction apparatus for practice of the present invention.

With reference now to FIG. 1 and 2, a four color multicolor electrophotographic reproduction apparatus is shown.

Figure 3:
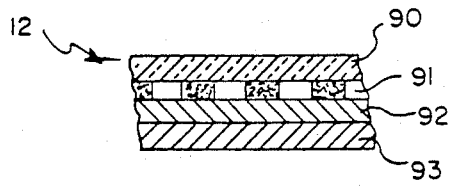
FIG. 3 is a schematic illustration in crosssection of some of the elements forming a multilayered photoconductive member for use in the apparatus of FIG. 2.

The apparatus 10 includes a closed loop, flexible image transfer member, or photoconductive web 12. The web 12, which may be of the type described in FIG. 3 is supported on rollers 5–8. The rollers are mounted on the copier frame (not shown) with one of the rollers, for example roller 5, rotatively driven by a motor 16 to effect continuous movement of the web 12 in a clockwise direction about its closed loop path. The web has a plurality of sequentially spaced, nonoverlapping image areas which pass successively through electrophotographic processing stations (charge, expose, develop, transfer, clean) located about the path of the web. The web also includes timing marks (or regularly spaced perforations) which are sensed by appropriate means, such as timing signal generator 17 to produce timing signals. Such signals are sent to a computer controlled logic and control unit 31. The LCU 31 controls the entire electrophotographic process based on the instantaneous location of the web in the travel path. An encoder 18 associated with the roller drive motor 16 also produces timing signals for the LCU. The signals from the encoder cause the LCU to fine tune the process timing. The LCU 31 has a digital computer, preferably a microprocessor. The microprocessor has a stored program responsive to the input signals for sequentially actuating, then de-actuating the work stations as well as for controlling the operation of many other machine functions.

Programming of a number of commercially available microprocessors such as one or more INTEL model 8086 microprocessor (which along with others can be used in accordance with the invention), is a conventional skill well understood in the art. This disclosure is written to enable a programmer having ordinary skill in the art to produce an appropriate control program for the microprocessor. The particular details of any such program would, of course, depend on the architecture of the designated microprocessor.

Figure 4:
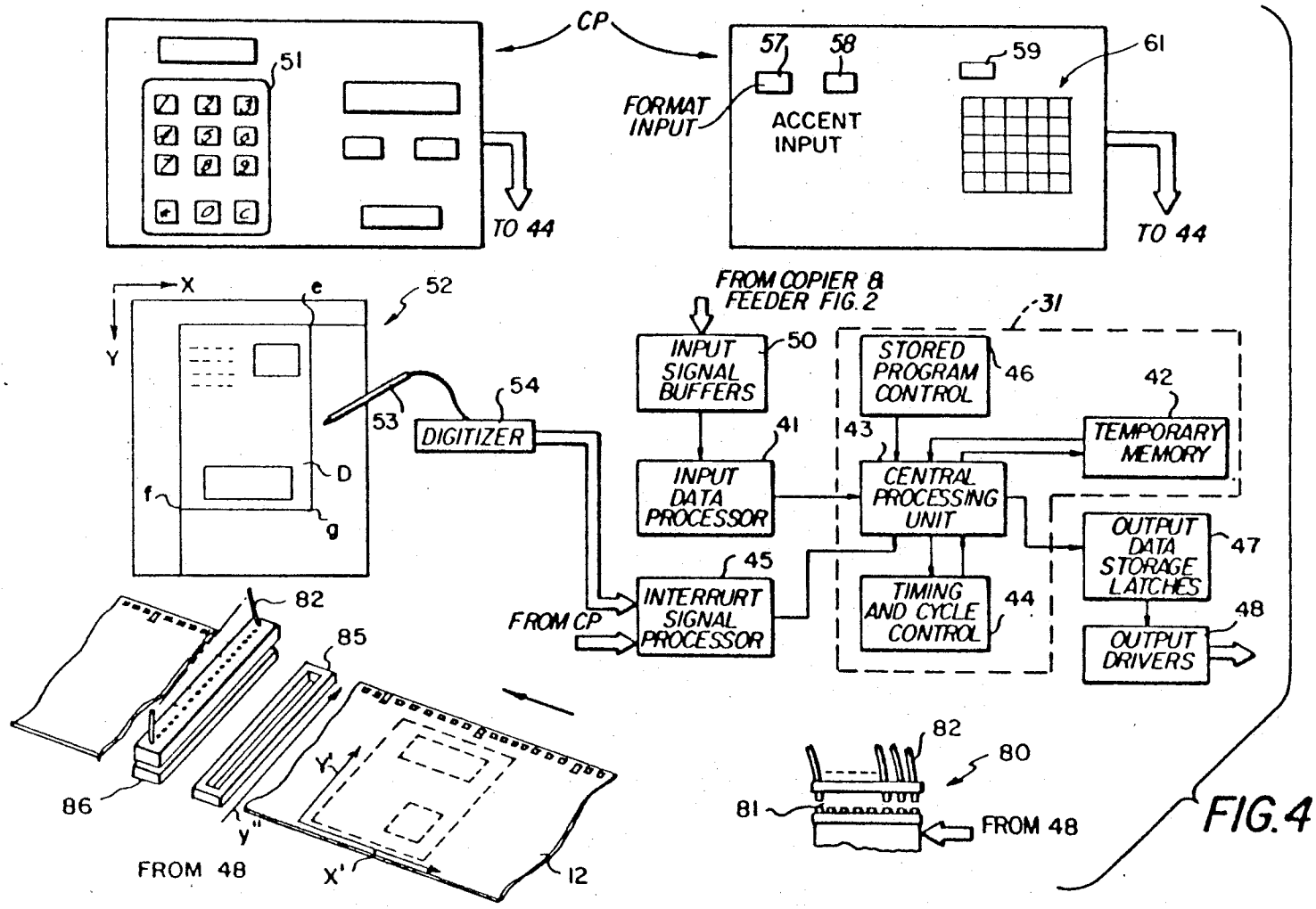
FIG. 4 is a schematic illustrating a data input station and block diagrams of controls for controlling the apparatus shown in FIGS. 1 and 2.

With reference also now to FIG. 4, a block diagram of logic and control unit (LCU) 31 is shown which interfaces with the apparatus 10. The LCU 31 consists of temporary data storage memory 42, central processing unit 43, timing and cycle control unit 44, and stored program control 46. Data input and output is performed sequentially under program control. Input data are applied either through input signal buffers 50 to a input data processor 41 or to interrupt signal processor 45. The input signals are derived from various switches, sensors, and analog-to-digital converters. The ouput data and control signals are applied to storage latches 47 which provide inputs to suitable output drivers 48, directly coupled to leads. These leads are connected to the various work stations, mechanisms and controlled components associated with the apparatus.

A multicolored original document sheet D to be reproduced is placed, image side down, on a transparent glass platen 20 supported by the copier frame. Exposure lamps 22, such as xenon flash tubes, are located beneath the platen 20 within the frame. The lamps flood the document sheet with light and a reflected image of the document sheet is transmitted via mirror 24, lens 26, and mirror 28 in focus to an area 30 lying in the plane of the web 12. The original document could, of course, be a transparency illuminated from the back side thereof. To reproduce an ordinary multicolored document in its original colors, the document sheet D is illuminated, for example, four times in succession to form four separate electrostatic latent image frames of the document. On successive illuminations a red filter 32R, a green filter 32G, or a blue filter 32B is inserted into the light path to form color separation images at the area 30. A fourth filter comprising a neutral density filter 32N for providing what is known as a skeletal black image is inserted during a fourth exposure of the original or may be used for coloring areas to be developed in black. The timing of the flash of lamps 22 and the insertion of the colored filters are controlled by the LCU and related to the travel of the web 12 to expose adjacent, nonoverlapping areas of the web to the color separation images and the skeletal black image. One or more corona charging units, exemplified by corona charger 34, is located upstream of the exposure area 30, and applies a generally uniform primary electrostatic charge, of say negative polarity, to the web 12 as it passes the charger and before it enters the exposure area. A programmable power supply may be provided to selectively apply to each image frame a predetermined generally uniform electrostatic primary charge level $V_o$ suitable for developing the particular color toner used to develop that image frame. The photoconductive properties of the web cause the primary charge in the exposed areas of the web to be discharged in that portion struck by the exposure light. This forms latent imagewise charge patterns on the web in the exposed areas corresponding to the respective black and color separation images. Travel of the web then brings the areas bearing the latent images into a development area 36. The development area has a plurality of magnetic brush development stations, corresponding to the number of formed black and color separation images, in juxtaposition to, but spaced from, the travel path of the web. Magnetic brush development stations are well known; for example, see U.S. Pat. No. 4,473,029 to Fritz et al and 4,546,060 to Miskinis et al. When the color separation images are red, green, blue and a skeletal black image is also to be provided, there are four development stations respectively containing complementary colored toner particles, i.e., cyan particles in station 36C, magenta particles in station 36M, yellow particles in station 36Y, and black particles in station 36B. The toner particles are agitated in the respective developer stations to exhibit a triboelectric charge of opposite polarity to the latent imagewise charge pattern. Backup rollers 38C, 38M, 38Y, and 38B, located on the opposite side of web 12 from the development area, are associated with respective developer stations 36C, 36M, 36Y and 36B. Actuators 40C, 40M, 40Y and 40B selectively move respective backup rollers into contact with the web 12 to deflect the web from its travel path into operative engagement with respective magnetic brushes. The charged toner particles of the engaged magnetic brush are attracted to the oppositely charged latent imagewise pattern to develop the pattern.

The logic and control unit 31 selectively activates the actuators in relation to the passage of the image areas containing corresponding latent color separation images through the development area 36. That is, as the area containing the latent red color separation image reaches the development station 36C, actuator 40C moves the backup roller 38C to deflect the web so that the latent charge image is developed by attracting cyan toner particles from the station 36C. As soon as the image area leaves the effective development area of the station 36C, the actuator 40C returns the backup roller 38C to its nondeflecting position. Thus, as the areas containing the green and blue color separation images and the neutral density latent image pass the developer station 36C, no development takes place. A similar cycle is accomplished by the logic and control unit 31 for the developer stations 36M, 36Y and 36B. In this manner, the red latent color separation image is developed only with cyan toner particles, the green latent color separation image is developed only with magenta toner particles, the blue latent color separation image is developed only with yellow toner particles, and the neutral density latent image is developed only with black toner.

The developed black and color separation images must be transferred to a receiver sheet in accurately registered superimposed relation to form a full color reproduction of the original document. Apparatus for providing such registered transfer are known, for example one of which is fully described in U.S. Pat. No. 4,477,176, issued Oct. 16, 1984 in the name of Matthew J. Russel the contents of which are incorporated herein by this reference. Briefly, this is accomplished by feeding a receiver sheet S from a supply stack stored in hopper 27 in synchronism with movement of the first image sector so that the copy sheet engages the web and is registered by mechanism 80 with the first image frame. A transfer roller 68 includes a compliant insulating surface thereon and is biased to a potential suitable for transfer of the developed image on the first image sector to the copy sheet S and to tack copy sheet S to roller 68. Roller 68 is driven by a stepper motor 19 which receives actuating signals from the LCU 31.

Roller 68 may also be a biased vacuum roller or a roller with sheet clamping mechanisms to clamp the sheet to it.

Continued movement of web 12 and synchronized rotation of roller 68 brings the lead edge of copy sheets back into transferable relationship with the web as the lead edge of the next toner image arrives at roller 68. At this point, sheet S remains tacked to roller 68 and the second toner image is transferred in superimposed registration with the first toner image on sheet S. The process is repeated until toner images on each of the first three image sectors have been transferred to the same surface of sheet S and the leading edge of copy sheet has been brought back into transferable relationship with the fourth toner image on the web. When the lead edge of copy sheet S is brought back into transferable relationship with web 12 for the last time, the bias on roller 68 is reversed to repel sheet S away from roller 68 back into contact with web 12. Copy sheet S will be carried by web 12 so that the copy sheet is in registration with the image on the fourth image sector. This image is transferred to the copy sheet by transfer charger 25. The copy sheet is separated from the web and conveyed by vacuum transport 60 or an air transport to roller fuser 62 where the transferred images are then fixed or fused onto the sheet. The sheet is then delivered to exit hopper 64 or an accessory finishing unit 69. While the image is being fixed to the receiver sheet, the web 12 continues to travel about its path and proceeds through a cleaning area 66.

To facilitate toner removal from the web, a corona charging station 70 and a rear erase lamp 71 may be located upstream of the cleaning unit 66 to neutralize any charge remaining on the web and thus reduce the adherence forces of the toner to the web.

Figure 5:
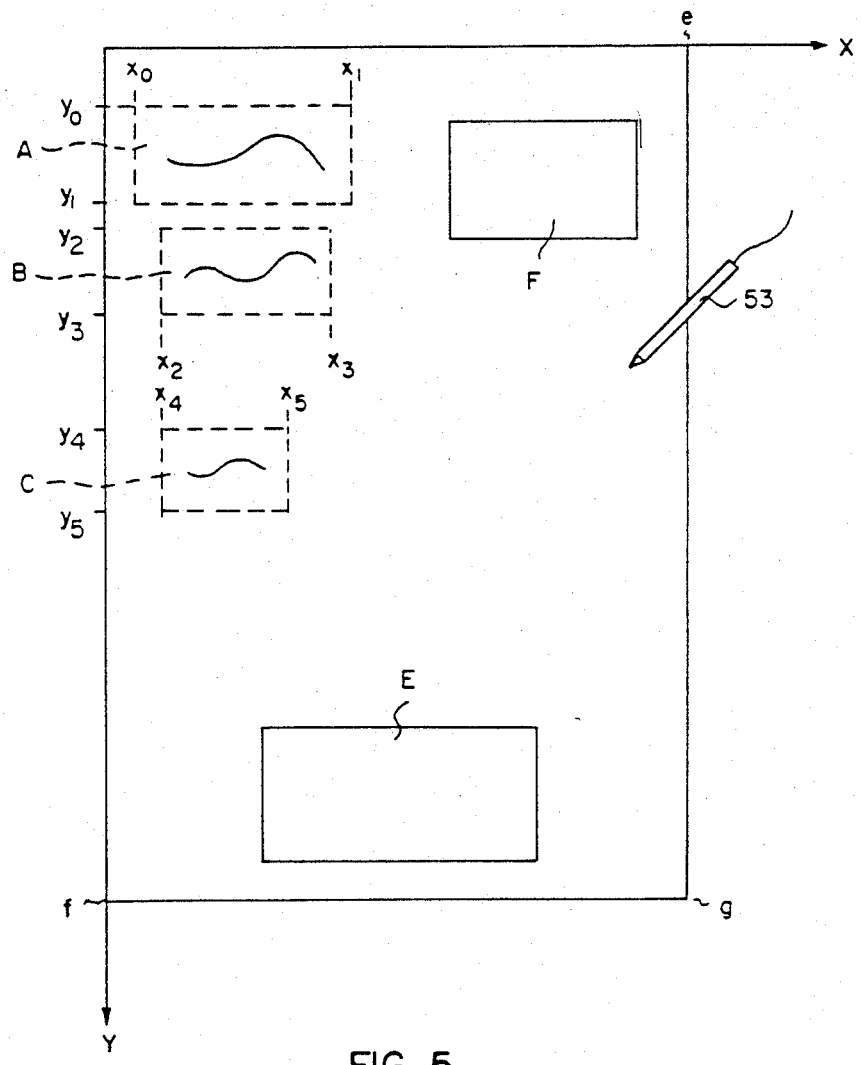
FIG. 5 is an illustration of a document that is to be reproduced with selected color accenting.

In order to reproduce a document sheet such as document sheet D (see FIG. 5) having composite information comprised of line-type information in areas A, B and C and multicolor continuous-tone information in areas E and F, the document sheet D is placed face up on a digitizing tablet 52 and registered against an appropriate corner (or centered relative to a predetermined edge) as shown in FIGS. 1, 4 and 5. A wand 53 is associated with the tablet and used by the operator to determine the format of the original and the locations of the various parts of the image information. Assuming line-type information on the original is in black and that the reproduction desired requires each to be in a different color the operator calls up a special program for accomplishing this task via inputs of a code on a keyboard 51 which is part of the control panel. Next, the operator presses a format input button 57 and moves the wand in turn to points e, f (or just point g which contains the coordinates of e and f) on the digitizing tablet to define the format of the document D. Transducers may be located beneath the sheet to produce signals relating the position of the points touched relative to the registered upper left corner of the sheet. Alternatively, the tablet may be of the known sonic type wherein a spark formed by a wand creates sound waves in the air which are sensed by microphones placed along the sides of the tablet or wherein a sensor is placed in the wand and sources at known points on the sides of the tablet emit sonic signals (see, for example, U.S. Pat. Nos. 4,012,588 in the name of Davis et al and 4,124,838 in the name of Kiss). A digitizer controller 54 knowing the times of emitting of the signals and their receipt can through triangulation principles calculate the location of a point on the platen relative to a known point such as the upper-left corner shown.

Next, the operator inputs the desired color for the information appearing in area A by depressing an accent input button 58 and one of the 25 color buttons 61 in the apparatus' menu of available colors and moves the wand to four or more points to define an imaginary rectangle or other area which encloses the information in area A and encloses no other information. For example, assume the selected color for this information is to be reproduced in red. The LCU is programmed to recognize that the area is bordered by the straight lines joining adjacent points and the coordinates for the rectangular area to be selectively colored are thus stored in temporary memory. Alternatively, the LCU may be programmed to recognize two diagonally opposite points as defining a rectangle. The LCU may also be programmed to receive inputs regarding other geometrical shapes. This information is outputted on the display 55 showing the relative position of the area A on the display, indicating the desired color accent for area A, and also illustrates the format of the document sheet D.

The operator then proceeds to repeat this for the next block of line-type information by indicating the color that it is to be reproduced. In this example, assume that area B is to be reproduced in its original black color using black toner only. An input, therefore, is needed to be provided to define area B and its color in a similar manner described for area A and a button 59 pressed to input this color.

Area C on the other hand is desired to be reproduced in a color, for example, a particular shade of orange that is included within the menu. To reproduce Area C in this color the operator, identifies the rectangular area C using the digitizer and depresses the button assigned for this color.

Inputs from the digitizer and the color select buttons are inputted into the LCU through interrupt signal processor 45 and are stored in temporary memory 42.

The operator next takes the document sheet D and places it on the exposure platen (using feeder 15 for example) so that the side to be reproduced faces the exposure lamps and registers the sheet with the appropriate corner (or centers it against a registration edge). The stored program control on the LCU has a program for compensating for the reversal of the sheet vis-a-vis the location of areas when the sheet is face-up versus the location of these areas when the sheet is turned over for exposure. Alternatively, format input may not be needed where the same point on the sheet is registered when the sheet is both face up and face down. For example, where the sheet is registered when face-up using centering of its left edge for digitizing and then inverted for exposure so that the same edge is again centered, the location of the digitized areas is known without need of format input.

The operator then indicates through a suitable means, such as a coded input or special button therefore, whether three color or four color processing is desired. Assumption will be made that four color exposure and processing is desired for the multicolored continuous tone photographs E and F.

Upon actuation of the print button, the apparatus operates as described above. However, as shown in FIG. 4, each color frame subsequent to exposure is passed between two linear illumination elements which extend across the width of the photoconductive web 12 transverse to the direction of web movement. A first illumination element 80 coupled to drivers 48 comprises LED's (light emitting diodes) 81 whose illumination is picked up by optical fibers 82 at one end thereof and carried to linear banks or holders where the fibers are aligned and spaced from a gradient index lens array 86 such as a Selfoc (trademark of Nippon Sheet Glass Co., Ltd.) array. This array focuses illumination exiting the fibers onto a photoconductive surface of web 12. Alternatively, a linear array of LED's may be located proximate the web to expose the web directly or through a Selfoc lens without use of optical fibers.

With reference now to FIG. 3, it will be noted that the photoconductive web 12 comprises a transparent support 90, a halftone screen 91, a conductive layer 92, and a photoconductive layer 93. The integral screen photoconductor may have the dot pattern that is printed therein rotated on adjacent frames so as to avoid moire patterns.

Figure 6:
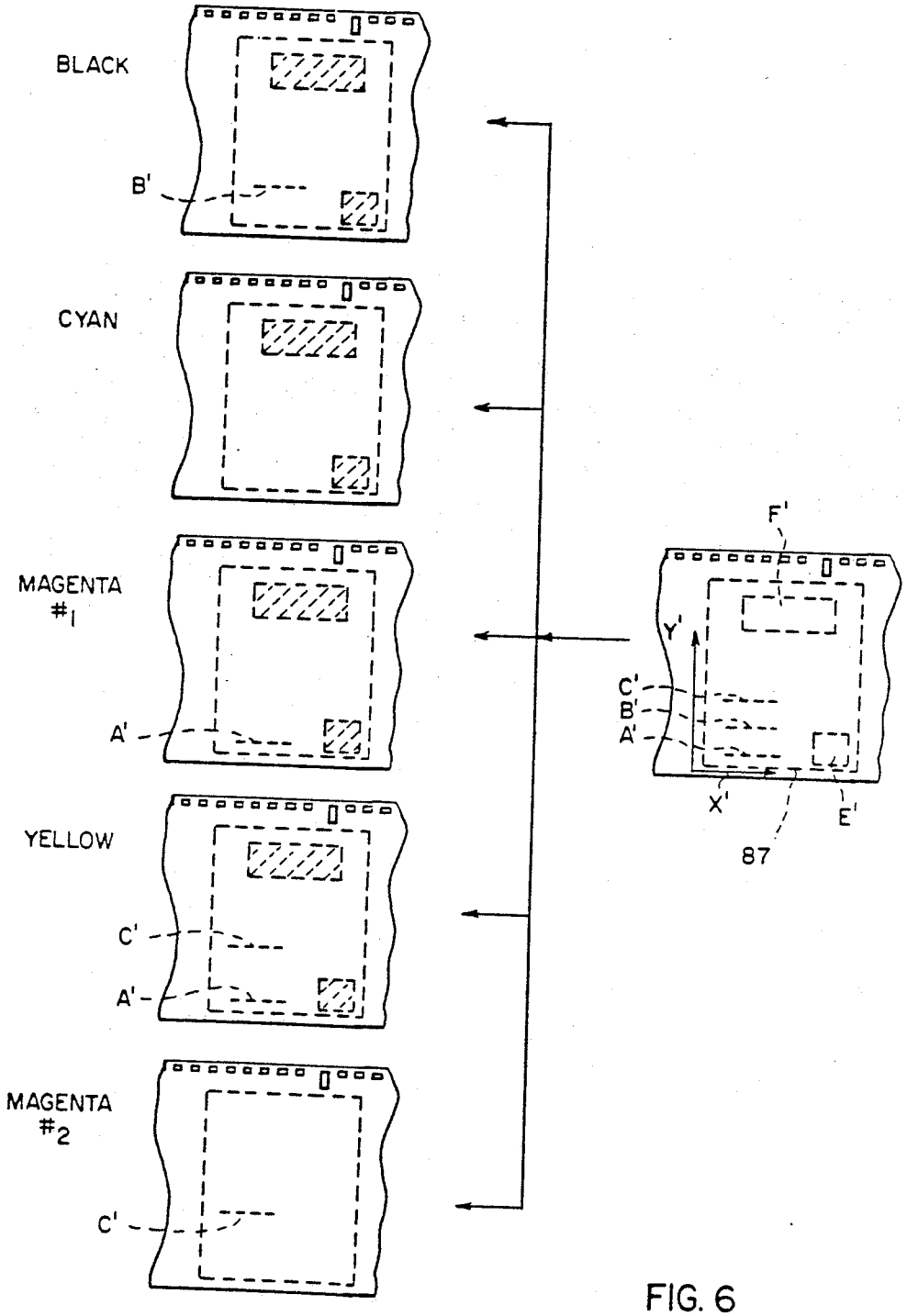
FIG. 6 is an illustration of various image frames on the photoconductor used to produce a color accented copy.

With reference now also to FIGS. 5 and 6, it will be noted that key points or coordinates associated with the original document D have corresponding coordinates associated with with each image frame 87 (designated by the x', y' axes) which relate to the coordinates of the original and which are used to enable illumination from respective portions on the linear exposure element 80 (y'' axes) at respective times established by corresponding x' abscissa coordinates.

The second linear exposure element 85 is an electroluminescent light panel which is also coupled to drivers 48. The illumination from the panel as controlled by the drivers 48, is such in this embodiment as to image a screen pattern onto the photoconductive surface of each image frame. The screen 91 is preferably formed of rows of dots. The dots may be colored such as magenta to operate with a complementary-colored (green) screen exposure light source of electroluminescent panel 85 which provides an exposure of the screen pattern on the photoconductive surface from the rear of the web. The screen, may be of "hard" or "soft" dots or may be comprised of lines or other shapes. Where the apparatus is primarily used to reproduce line-type information, the screen is preferably formed of "hard" dots or lines to form more uniform dots or lines over an image frame where the electroluminescent panel may be providing nonuniform output over its length. The panel 85 in response to signals from the drivers is capable of generally uniformly outputting two levels of light throughout its linear length. The first level is a relatively low level that is adapted to image a screen pattern on an image frame of the photoconductor to screen all image areas thereof. However, the level of screen exposure will be relatively low and reduce the primary voltage lev $V_o$ to a new level only about 60 volts or so from its normal level of about 500 volts. This new level of $V_o$ would be measured over a large area and comprises an average of charge levels in this area. The effect of this will be to screen continuous tone areas and to break up large solid areas which might show mottling of developer if not screened. The second level illumination level is the relatively higher one and is adapted to not only image a screen pattern on an image frame but will reduce the average charge level of the image frame to one-half $V_o$.

The black frame is the first to be exposed to illumination from the document sheet D and is exposed through the neutral density filter 32N. As this frame passes between the linear exposure elements, those LED's 81 providing illumimination to the upper (as viewed in FIG. 4, lower as viewed in FIG. 2) linear exposure element between the ordinates corresponding to $y_o$, $y_1$ and $y_4$, $y_5$ are all turned on to substantially erase all charge on the portion of this image frame between abscissa lines corresponding to $x_o$ and $x_l$, and $x_4$ and $x_5$, respectively, to erase the charge areas on this frame reproducing the information in rectangles A and C, respectively. The electroluminescent light panel 85 is turned on to its low level and illuminates a screen pattern over this entire image frame.

The cyan frame is the next to be exposed to illumination from the document sheet D and is exposed through a red filter 32R. As this frame passes between the linear exposure elements, selected LED's provide ilumination between the ordinate line pairs corresponding to $y_o$, $y_1$, $y_2$, $y_3$ and $y_4$, $y_5$, commencing with the abscissa lines corresponding with $x_o$, $x_2$ and $x_4$, respectively and terminating with $x_1$, $x_3$ and $x_5$, respectively. This being done to erase all charge information in areas on this frame reproducing information in rectangles A, B and C. The electroluminescent panel is kept turned on for this frame too at its low level to image a screen pattern on this image frame where charge remains.

The first magenta frame is the next to be exposed to illumination from the document sheet D and is exposed through a green filter 32G. As this frame passes between the linear illumination elements, selected LED's provide illumination between the ordinate line pairs corresponding to $y_2$, $y_3$ and $y_4$, $y_5$, commencing with the abscissa lines $x_2$, $x_4$, respectively, and terminating with the abscissa lines $x_3$, $x_5$, respectively. This being done to erase all charge information in areas in this frame reproducing information in rectangles B and C. The electroluminescent panel 85 is kept turned on at its low level for this frame, too.

The yellow frame is the next to be exposed to illumination from the document sheet D and is exposed through a blue filter 32B. As this frame passes between the linear illumination elements, selected LED's provide illumination between the ordinate line pair corresponding to $y_2$, $y_3$ commencing with the abscissa line corresponding to $x_2$ and terminating with the abscissa line corresponding to $x_3$. This being done to erase all charge information on areas in this frame reproducing information in rectangle B. The electroluminescent light panel 85 is illuminated at its low level for this image frame, too.

A fifth image frame to be developed with magenta toner is also provided with a primary charge and is also exposed to document D by flashlamps 22. As this frame passes between the linear illumination elements, selected LED's are illuminated to erase all charge information but for the information in areas on this frame reproducing information in rectangle C. The electroluminescent panel 85 is turned on at its high level for this frame to reduce the charge level at unexposed areas of this frame in rectangle C to a level of one-half $V_o$.

The five image frames are serially developed with respective colored toners (the fifth image frame being developed with magenta toner in this example) and the developed images thereon transferred in register to receiver sheet S. With the apparatus shown in FIG. 2, the first four image frames are transferred using transfer roller 68 and the fifth image frame transferred using transfer charger 25. Alternatively all image frames may be transferred using transfer roller 68. The developed images are fixed and delivered to hopper 64 or accessory finishing unit 69.

The resulting copy sheet includes reproductions of the photographs E and F which are reproduced in 4 colors and halftone screened to reduce contrast. The reproduction of area A originally in black is reproduced in red through combination or super position of magenta and yellow colored toners. The reproduction of area B is in black using only black toner. The reproduction of area C is in orange comprising a combination of a substantially $V_o$ charge level in the yellow developed frame and one-half $V_o$ charge level to one of the magenta developed frames. The screening of all information will be particularly beneficial to large solid areas which tend to appear mottled and of non-uniform color when developed without such screening.

The apparatus as described herein is adapted to provide transfer of up to seven image frames, four devoted to images having charge levels averaging about $V_o$ and three devoted to images having charge levels averaging about one-half $V_o$. Where additional colors beyond 25 are desired, additional frames at still another voltage level may be provided for.

The invention also contemplates the use of a light source which can accurately reduce charge levels in selected areas of an image frame based on color accenting desired. Where, for example in response to inputs from the document digitizer, a one half $V_o$ level can be established on selected areas of the first magenta frame while leaving other areas on the same frame at substantial $V_o$ then the use of additional frames beyond three and four may be dispensed with. For example, variable output light sources with variable aperture arrays such as mechanically moveable masks or alternatively electrically actuated masks such as PLZT arrays may be used to control screen illumination. PLZT is an abbreviation for a lead lanthanum zirconate titanate electro-optical material whose optical properties can be changed by an electric field. Illuminating panels or aperture arrays need not be linear, but can be areal and cover the area of the frame so that as a respective frame of the photoconductive web underlies the panel array illumination may then be selectively provided.

An interesting feature of some LED's emitting green colored light is that they are known (see U.S. Pat. No. 4,538,900 to Lutus et al, issued Sept. 3, 1985), when providing a different level of drive current thereto, to change spectral content such as to red. Where a magenta colored ink is used for the halftone screen, the green colored light content of the LED's may be used to image a screen pattern on the electrostatic charge on the photoconductor in accordance with the requirements of the areas requiring selective screening and reduction of the average charge level to say one-half $V_o$. On the other hand, whenever areas of the photoconductor are required to be substantially erased of charge such as areas in an image frame to be selectively erased or interframe and edge areas of the photoconductor the current level to the LED's may be adjusted to provide light outputs in the red color. Red color light is absorbed substantially less by the magenta dots compared with green colored light and thus the magenta colored screen is substantially transparent to light of red color. Control programs are known for illuminating a linear light source lying transverse to the direction of movement of a photoconductor for providing selective erase of charge from interframe and edge areas in accordance with encoded signals to the LCU determining the timing for illuminating a light source, at say, when the interframe area is positioned to be exposed to the light from the light source. An apparatus thus providing currents to selected LED's at levels suitable for generating light of a color to which the screen is transparent, for providing selective erase, and providing different currents to the LED's for generating light of a color to which the screen is not transparent, for providing selective screening, allows for the elimination of the need for an additional light source to provide the erase function.

The invention is not limited to the use of a photoconductor with an integral screen. The screen may be separate from the photoconductor and when it is so, may be positioned adjacent the surface of the photoconductor that is to be developed.

While the invention has been described with regard to a flash exposure of a document, other types of exposure are also contemplated. For example, the image may be scanned upon the electrostatically charged photoconductor and may be imaged thereon using either a scanning reflection or transmission exposure of the original or using light which has been electronically generated from say a bit stream. In the former segments of the original are scanned by a light source and the light modulated by the document is imaged upon the photoconductor. In the latter the information contents of a document are digitized into electrical signals by a suitable electronic image "reading" device and these signals used to modulate a light source such as a laser or LED arrangement which are then imaged upon the photoconductor. The image for the screen itself would be imaged upon the photoconductor independently of the imaging source by the techniques described herein or their equivalent, however the selective erase function provided by the LED's could be incorporated into an electronic imaging device. The advantage to this would allow the electronic imaging source to be fed by a black only bit generator; yet 25 or more colors are available for accenting.

Additional color levels may be provided for by incorporating a multicolor screen within the photoconductor and using multicolor illumination to illuminate a screen pattern on the image frames. As used herein, light modulated only with a screen pattern is still considered to be "non-image information bearing light." For example, a screen may be used comprising a 60% dot magenta screen with a 30% dot cyan screen placed so that the dots of the two colored screens do not overlap. When an image frame is illuminated by the non-image information bearing red light, the charge level on the frame is reduced to 30% of $V_o$; i.e., a 70% discharge level. When an image frame is illuminated by non-image information bearing green light, the charge level on the frame is reduced to 60% of $V_o$; i.e., a 40% discharge level. With both lights on the charge on the image frame would be reduced to a level below which development can occur or 100% discharged. With no lights on, there is no discharge and the charge on the image frame remains at $V_o$. Thus, four discharge levels are possible and $4^3$ or 64 colors are possible using three different color toners such as cyan, magenta and yellow. In a three color station apparatus no more than nine image frames would be needed to produce copy with all 64 colors.

Other modifications may include the use of a high percentage dot screen over a non-image bearing light source and repeated exposure of the photoconductor layer through the screen by the light source. The screen frequency can be varied in the direction of film motion by varying the frequency of light pulses exposing the photoconductor layer under the dot screen. The effective percent dot exposure is directly proportional to the frequency. For a 90% opaque dot pattern, exposures of zero to one hundred percent (0–100%) in 10% increments are possible producing 103 or 1000 possible colors; for an 80% opaque dot pattern, exposures of zero to one hundred (0–100%) in 20% increments are possible producing $5^3$ or 125 possible colors.

While the invention in its preferred embodiments has been described with regard to the use of exposure to a screen to effect the charge level on a frame, the invention in its broader aspects contemplates other means which will be suggested by this specification for accomplishing more than $2^3$ colors in a three color apparatus (or more than $2^2$ colors in a two color apparatus). For example, illumination sources or even charging devices which can be accurately controlled without use of a screen may be used to reduce the charge to a predetermined percentage of $V_o$ on a desired image frame to obtain an accent or spot color effect. The advantage, however, to use of a screen is that the resulting reproduction appears to be more appealing and forgiving with regard to non-uniformities in light output. In lieu of using a screen, a high-resolution addressable light source may be used to synthesize a screen-like pattern.

Description has been provided herein with regard to reproduction apparatus using belts or webs or sheets where exposure of different image sectors refers to spatially different portions of the photoconductors described. It should be appreciated, however, that where smaller photoconductors are used, the image sectors may be considered different in the temporal sense. For example, a photoconductor may be exposed to an image of an original, be developed and transferred to a copy sheet, the photoconductor cleaned, and the next exposure of the original be on the same photoconductor portion.

It will be appreciated that signals from the LCU based on the menu colors selected determines the number of image frames to be exposed to the original document. The stored program control 46 stores the information regarding, for each color selected, the number of image frames needed to produce that color and how many of such frames are to be at about the average $V_o$ level and how many that are to be at the average one-half $V_o$ level (in an apparatus having 25 color levels plus black and white). The selective erase light source and the screen light source locations are not critical other than each being locatable between the primary charging station and the development station.

The invention has been described in detail with particular reference to the preferred embodiment thereof, but it will be understood that variations and modifications can be effected within the spirit and scope of the invention.

We claim:

1. A method for electrophotographically producing copy having selected information with color accenting, the method comprising the steps of;

(a) generating signals related to the desired color and position of an image area to be color accented relative to a reference;

(b) forming on a plurality of image frames of a photoconductive member a corresponding plurality of separate developable latent electrostatic images of the said information to be reproduced on the copy with selected accenting;

(c) exposing at least one of the image frames to non-image information bearing light modulated by a halftone screen pattern before, during or subsequent to step b) to reduce the charge level on an area corresponding to that for producing said selected information without similarly exposing the image(s) of the same information on another image frame to the same extent;

(d) developing the latent electrostatic images with differently colored electroscopic toners (e) transferring the developed images in register to a copy sheet.

2. A method for faithfully electrophotographically reproducing multicolored information in a document original and yet providing the reproduction with color accenting of selected other information found in the original, the method comprising the steps of:

(a) generating signals related to the desired color and position of the image area to be reproduced in a color different from that in the original;

(b) uniformly charging each of several image frames with a respective primary charge;

(c) exposing each of the several image frames to light modulated by the original with some of said image frames being exposed through respective color filters to form a plurality of color separation images of the document;

(d) exposing in accordance with the signals of step (a) a portion of at least one of the image frames used to reproduce the information to be color accented to reduce the charge level of such information in said image frame to a level which will permit development without similarly reducing the level of charge to the same extent in another image frame used to reproduce the same information to be color accented and which said another image frame is also used to faithfully reproduce the multicolored information;

(e) developing the latent electrostatic images with the said one and another image frames each being developed with differently colored electroscopic toners; and (f) transferring the developed images in registered relationship to a support wherein a sufficient number of transfers are made to faithfully reproduce the multicolored information that is to be so reproduced and providing additional transfers of other image frame(s) used for color accenting of the information to be so accented.

3. A method for electrophotographically reproducing an original document with faithful reproduction of multicolored information and color accenting of other information in the document, the method comprising the steps of:

(a) generating signals related to the desired color and position of the image area to be reproduced in a color different from that on the original;

(b) uniformly charging each of several image frames with a respective primary charge;

(c) exposing each of the image frames to light modulated by the original while forming a plurality of color separation images of the information to be faithfully reproduced;

(d) selectively erasing from one or more image frames information directed to the multicolor information to be reproduced to preclude development of such information on said one or more frames;

(e) reducing the charge remaining on the one or more image frames to a level(s) which will allow development of the information to be color accented in accordance with the color selected;

(f) developing the latent electrostatic images in the image frames with respectively colored electroscopic toners; and transferring the developed images in registered relationship to a support.

4. An electrophotographic reproduction apparatus for producing copy in a desired color, the apparatus comprising:

(a) a photoconductive member;

(b) means for depositing respective primary charge(s) to two or more image frames of the member;

(c) means for exposing each of at least two of the image frames so as to form electrostatic charge patterns of the information to be reproduced in the desired color;

(d) means for generating a signal indicative of the said desired color;

(e) means responsive to the said signal for adjusting the primary charge level in at least one of the said two image frames to a still developable level, without use of image information bearing illumination, to control the amount of development material used to develop the information in said frame and thereby effect the resulting color of the information reproduced;

(f) means for developing the image frames with differently colored development materials; and (g) means for transferring the images on the frames in register to a support so that there is formed on said support a visible image of the information in a color different than that used to develop any of the image frames.

5. The apparatus according to claim 4 and wherein the means in (e) comprises an illumination source for exposing a screen pattern on the image frame.

6. The apparatus of claim 5 and wherein the photoconductive member includes an integral screen and wherein the means in (e) illuminates the image frame through the integral screen.

7. The apparatus of claim 4 and including digitizing means for determining the location of the information to be reproduced in the desired color and means responsive to signals generated by said digitizing means for erasing charge from one of said image frames.

8. An electrophotographic reproduction method for producing copy in a desired color, the method comprising the steps of:

(a) forming respective primary charges on two or more image frames of a photoconductive member;

(b) exposing each of at least two of the image frames so as to form electrostatic charge patterns of the information to be reproduced in the desired color;

(c) generating a signal indicative of the said desired color;

(d) in response to said signal, adjusting the primary charge level accordingly to a still developable level in at least one of the said two image frames, without the use of image information bearing illumination, to control the amount of developable material used to develop the information in said frame and thereby effect the resulting color of the information reproduced;

(e) developing the image frames with differently colored development materials; and (f) transferring the images on the frames in register to a support so that there is formed on said support a visible image of the information in a color different than that used to develop any of the image frames.

9. The method of claim 8 and wherein in step (d) the primary charge level is adjusted using an illumination source which exposes a screen pattern on the image frame.

10. An electrophotographic reproduction apparatus comprising:

(a) a photoconductive member;

(b) means for depositing respective primary charge(s) to two or more image frames of the member;

(c) means for forming an electrostatic charge pattern of the same information on each of said at least two image frames;

(d) means for generating a signal of the desired color to reproduce said information;

(e) means independent of the means in (c) and responsive to said signal for modulating the charge on at least one of the image frames so that the charge level reproducing the information is adjusted to a still developable level;

(f) means for developing the two image frames with differently colored materials; and (g) means for transferring the information on the image frames in register to a support so that there is formed on said support a visible image of the information in a color different than that used to develop any of the image frames.

11. The apparatus of claim 10 and wherein the means in (e) comprises an illumination source for providing a screen pattern on the image frame.

12. The apparatus of claim 11 and including means for selectively erasing charge from an area of an image frame to prevent information in said area from developing.

13. The apparatus of claim 10 and including digitizing means for determining the location of the information to be reproduced in the desired color and means responsive to signals generated by said digitizing means for erasing charge from one of said image frames.

14. An apparatus for reproducing information located in a portion of a document sheet, the reproduction being in a selected color different than that of the original, the apparatus comprising:

(a) means for providing signals identifying the said portion of the document;

(b) operator-accessible means for selecting a color and generating a signal indicative of such selection;

(c) a support for supporting an electrostatic image;

(d) means responsive to said signals of said means in both (a) and (b) for forming an electrostatic charge pattern of the information on two or more image frames of the support in accordance with the color selected;

(e) means for developing the image frames with differently colored development materials, the development materials being of a different color than said selected color;

(f) means for transferring the images on the frames in register to a different support so that there is formed on the different support a visible image of the information in the selected color.

15. The apparatus of claim 14 and wherein the means in (a) comprises digitizing means for defining a set of coordinates relative to a reference of an area on the document sheet wherein the information is located.

16. An apparatus for producing a copy sheet having a first set of information in a first selected color and a second set of information in a second selected color different than first color, the apparatus comprising:

(a) means providing signals identifying the portion having the first set of information;

(b) means providing signals indicating selection of the first color for said first set of information and the second color for said second set of information;

(c) a support for supporting an electrostatic image;

(d) means responsive to said signals of said means in both (a) and (b) for forming an electrostatic charge pattern of the first set of information on two or more image frames of the support in accordance with the color selected and for forming an electrostatic charge pattern of the other set of information on at least one image frame of the support in accordance with the second color selected;

(e) means for developing the image frames with differently color development materials; the development materials being of a different color then said first selected color; and (f) means for transferring the images on the frames in register to a different support so that there is formed on the different support a visible image of the first set of information in the first selected color and a visible image of the second set of information in the second selected color.

17. An apparatus for producing a copy sheet having a first set of information in a first selected color and a second set of information in a second color different than said first; the apparatus comprising:

(a) means providing signals identifying the portion having the first set of information;

(b) means providing signals indicating selection of the first color for said first set of information;

(c) a support for supporting an electrostatic image;

(d) means for forming an electrostatic charge pattern of the first and second sets of information;

(e) means for developing into colored visible images the electrostatic charge patterns of the first and second sets of information using color development materials different in color than said first selected color;

(f) means for transferring the colored visual images to a copy sheet so that there is formed on the copy sheet a visible image of the first set of information and a visible image of the second set of information; and (g) means for adjusting, in accordance with the signals provided by the means in (b), the relative amounts of each of the color development materials transferred to the copy sheet for providing the visible images of the first set of information in the first selected color.

18. A method for producing a copy sheet having a first set of information in a first selected color and a second set of information in a second selected color different than said first color, the method comprising:

(a) generating signals identifying the portion having the first set of information;

(b) generating signals indicating selection of the first color for said first set of information;

(c) forming an electrostatic charge pattern on a support of the first and second sets of information;

(d) developing into colored visible images the electrostatic charge patterns of the first and second sets of information using color development materials different in color than said first selected color;

(e) transferring the colored visual images to a copy sheet so that there is formed on the copy sheet a visible image of the first set of information and a visible image of the second set of information; and (f) adjusting, in accordance with the signals provided in step (b), the relative amounts of each of the color development materials transferred to the copy sheet for providing the visible image of the first set of information in the first selected color.

19. An apparatus for producing a copy sheet having information in a selected color that is different than the colors of the materials used to develop same and their complementary colors;

(a) operator accessible control panel means identifying a plurality of specific colors for selection by the operator including colors substantially different than the colors of pg,37 the materials used to develop same and their complementary colors;

(b) means responsive to selection of the selected color for generating a signal specific to such selection;

(c) support means for supporting an electrostatic charge;

(d) means for establishing on no more than two image frames of the support means a respective electrostatic charge of the image information;

(e) means for developing into colored visible images the electrostatic charge patterns on the first and second image frames using two differently colored development materials, one for each of the image frames, the colors of the materials and their complementary colors being substantially different than the selected color;

(f) means for transferring the colored visible images in register to a copy sheet so that there is formed on the copy sheet a visible image of the information in the selected color; and (g) means for adjusting, in accordance with the signal generated by the means in (b), the relative amounts of the color development materials transferred to the copy sheet for providing the information on the copy sheet in the selected color.

* * * * *